United States Patent [19]

Stog

[11] 4,211,612

[45] Jul. 8, 1980

[54] DEVICE FOR COLLECTING EMISSIONS RISING FROM A QUENCHING CAR OF A BATTERY OF COKE OVENS

[75] Inventor: Wilhelm Stog, Waltrop, Fed. Rep. of Germany

[73] Assignee: WSW Stahl- und Wasserbau GmbH, Waltrop, Fed. Rep. of Germany

[21] Appl. No.: 925,380

[22] Filed: Jul. 17, 1978

[30] Foreign Application Priority Data

Jul. 21, 1977 [DE] Fed. Rep. of Germany ..... 7722885

[51] Int. Cl.[2] ..... C10B 17/04; C10B 39/00

[52] U.S. Cl. ..... 202/263; 202/227; 202/262

[58] Field of Search ..... 98/115 VM; 202/230, 202/263, 262, 227, 228, 229; 201/39

[56] References Cited

U.S. PATENT DOCUMENTS

| | | | |
|---|---|---|---|
| 3,801,473 | 4/1974 | Schoew | 202/263 |
| 3,844,900 | 10/1974 | Schulte | 202/262 |
| 4,113,572 | 9/1978 | Manda et al. | 202/262 |

FOREIGN PATENT DOCUMENTS

| | | | |
|---|---|---|---|
| 2326630 | 12/1974 | Fed. Rep. of Germany | 202/263 |
| 749184 | 10/1970 | France | 202/263 |
| 7603112 | 9/1976 | Netherlands | 202/263 |

*Primary Examiner*—R.E. Serwin
*Assistant Examiner*—Chris Konkol
*Attorney, Agent, or Firm*—Becker & Becker, Inc.

[57] ABSTRACT

A device for collecting emissions rising from a quenching car of a battery of coke ovens which device is displaceable on rails parallel to the battery of coke ovens and a collecting conduit for the emissions of the quenching car. The device includes a withdrawal connection for the emissions which is connectable to desired spots of the collecting conduit. The device also includes a first hood above which there is provided a collector for the emissions which extends in the longitudinal direction of the first hood. At one end of the first hood the collector is provided with a transition or conveying member from the first hood to the collector. This transition or conveying member has associated therewith a pre-adjustable throttle flap. The other end of the collector is provided with a connecting section for a corresponding opening provided in a second hood which extends over the coke mass transporting carriage the collector is provided with a withdrawal connection having a shut-off flap for interrupting the connection between the collector and the collecting conduit.

7 Claims, 2 Drawing Figures

DEVICE FOR COLLECTING EMISSIONS RISING FROM A QUENCHING CAR OF A BATTERY OF COKE OVENS

The present invention relates to a hood or bell for catching the emissions which rise from a quenching car of a battery of coke ovens. The hood or bell is displaceable on rails parallel to the battery of coke ovens, a collecting main for the emissions or the quenching car and at a desired spot comprises a withdrawing connection for the emissions. The withdrawing connection is connectable to the connecting main.

When spinning or pushing (Drücken) the individual chambers of a coke oven, due to the falling coke on the coke side, considerable quantities of dust, gases and smoke are obtained which have to be caught and conveyed to a central purifying device. Accordingly, the transporting car for the coking mass is provided with a hood. Also above the quenching car there is provided a displaceable hood which is movable on rails parallel to the rails for the quenching car and independently of the latter. It is known to convey the emissions from the hood of the car for transporting the coke mass below the hood of the quenching car and from there to withdraw the emissions by providing a connection between the hood of the quenching car and collecting main which leads to the central purifying device. For purposes of conveying the gases into the collecting main, the collecting main is covered by a flat band which can be lifted within the region of the quenching car hood by means of a band or belt looping carriage (Bandschleifenwagen), in order to convey the emissions into the collecting main. With these known arrangements, the suction blowers of the central purifying device have to be designed for a high output in order to assure a sufficient differential pressure over the entire length of the battery of coke ovens. The differential pressure will assure a proper withdrawal of the emissions also on said oven chambers which are farthest from the central purifying device. Even more powerful suction blowers have to be provided when a plurality of batteries of coke ovens for instance four batteries are connected to the central purifying device. With four batteries, usually two quenching carriage hoods are utilized which have considerable air cross sections and thus make more difficult the build-up and the maintenance of a sufficient pressure differential. Furthermore, the hot gases and wind influences continuously cause pressure variations which likewise have to be taken into consideration when designing the suction blowers. The pressure variations correspondingly multiply when utilizing a plurality of batteries of coke ovens.

It is, therefore, an object of the present invention to provide a hood for the quenching cars of a battery of coke ovens in which more uniform flow conditions prevail which at the same time will make it possible to reduce the power for the suction blowers for withdrawing the emissions.

These and other objects and advantages of the present invention will appear more clearly from the following specification in connection with the accompanying drawings, in which.

The problem underlying the present invention has been solved according to the present invention by providing above the hood a collector for the emissions. The collector, at a transition extending from the hood to the collector and located at one end of the hood comprises a pre-adjustable throttle valve. The other end of said collector is provided with a connecting pipe section for a corresponding opening on a hood covering the carriage for the coke mass. The collector supports the withdrawal pipe section. The withdrawal pipe section comprises a shut-off valve for interrupting the connection between the collector and the main. In this way the advantage will be obtained that the pressure differential in the collecting mains can be kept substantially constant, especially when a plurality of collecting mains are provided for a corresponding number of batteries of coke ovens. This will be made possible by the collector and its construction. The collector at the entrance of the emissions into the collecting mains assures constant flow conditions. The constant flow conditions are pre-adjustable by the throttle valve and are adapted to be controlled by the throttle valve in conformity with the respective condition of operation. Within the region of the dropping coke, the emissions are strongest. With the invention, it is possible to take up this greater quantity of emission by a higher suction power than the other emissions which rise from the quenching carriage. Accordingly, the pre-adjustable throttle valve is provided at that end of the collector which is located opposite the connecting pipe sections for the hood of the carriage for the coke mass while the coke drops through the connection section into a corresponding chute. The shut-off valve is provided with a control element which is adapted to be remote controlled from a control center so that when utilizing two quenching car hoods, only the throttle valve of that hood is opened which is provided on an oven chamber that is just being spun or pushed.

Figure 1:
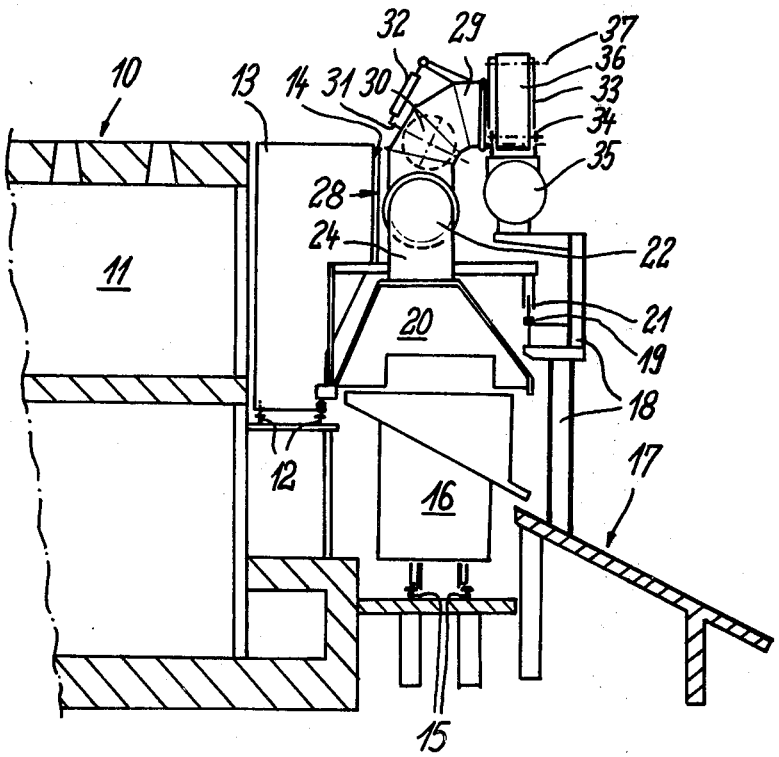
FIG. 1 is a front view of the hood according to the invention.

Referring now to the drawings in detail, FIG. 1 shows the coke side of a battery 10 of coke ovens with a coke oven chamber 11 in cross section. Parallel to the battery 10 of coke ovens, there is provided a track 12 for a coke mass transporting car for which the hood 13 is shown. The hood 13 is provided with a rectangular vertically extending opening 14 which is aligned with the oven chamber 11 and which is respectively aligned relative to the transport carriage for the coke mass.

On rails 15 parallel to the battery of coke ovens, there is movably arranged a quenching car 16 followed on the coke side by a coke ramp 17. On supports 18 there is arranged a rail 19 which likewise extends in the longitudinal direction of the battery 10 of coke ovens. On rail 19 and a rail of the track 12 for the coke mass, there is arranged a hood 20 which is movable in the longitudinal direction of the battery 10 of coke ovens. The hood 20 has a rectangular plan view so that the quenching car 16 can be displaced independently of the hood 20. The hood 20 is of a roof-shaped construction and is provided with a supporting frame which is arranged in a bridge-like manner above the quenching car 16 and has carriage means 21 movable on the rail 19 and a rail of the track 12. The hood 20 is open in the direction of the quenching car 16.

Above the hood 20, a collector 22 extends in the longitudinal direction of the hood 20. The collector 22 according to the embodiment shown has a circular cross section. At one end of the hood 20 there is provided a bent pipe 24 which heads from an opening in the ceiling of hood 20 into the collector 22. At the entrance into the collector there is provided a throttle valve 25. When starting the battery of coke ovens, the throttle valve 25 is fixedly adjusted.

At the other end 26 of hood 20, a substantially vertical chute 27 is placed upon the hood 20 and directly communicates with the horizontally extending collector 22. As will be seen from FIG. 3, the chute 27 has a substantially circular cross section, and in the direction of the carriage for the coke mass has a rectangular connecting section 28. The connecting section 28 is adapted to the cross section of the opening 14 of hood 13 of the carriage transporting the coke mass. Approximately in the center of the collector 22, a withdrawal connection 29 is placed thereupon. Within the withdrawal connection 29 which is designed as a bent pipe, there is provided a shut-off valve 30 having a flap mounted for pivoting about an axis 31. This shut-off valve 30 is adjustable at will from the outside by means of a pressure cylinder 32. The pressure cylinder piston system 32 may be actuated pneumatically or hydraulically. Instead of the pressure cylinder piston system 32, also an electric adjusting member may be utilized.

At the free end of the withdrawal connection 29 there is provided a belt looping carriage 33. This carriage is movable by means of rollers 34 on rails of a collecting main 35. The collecting main 35 is arranged on supports 18 above the rail 19 and extends in the longitudinal direction of the battery 10 of coke ovens. The connecting main 35 comprises a pipe which is open at the top and is provided with a flat cover band 36 which is lifted off the carriage 33 and is guided by means of rollers 37 on carriage 33. The carriage 33 has a housing which is connected to the bend of the withdrawal connection 29 and downwardly in the direction of the collecting main 35 has an opening to convey the emissions such as dust and gases out of the collector 22 through the withdrawal connection 29 into the collecting line 35. At the end of the battery 10 of coke ovens, the collecting line 35 is connected to a centrally located purifying device which comprises a suction blower that creates a sufficient underpressure within the collecting conduit 35 as well as the collector 22 and is arranged below the hood 20 for the quenching car 16 and below the hood 13 for the carriage transporting the coke mass.

Figures 2, 3:
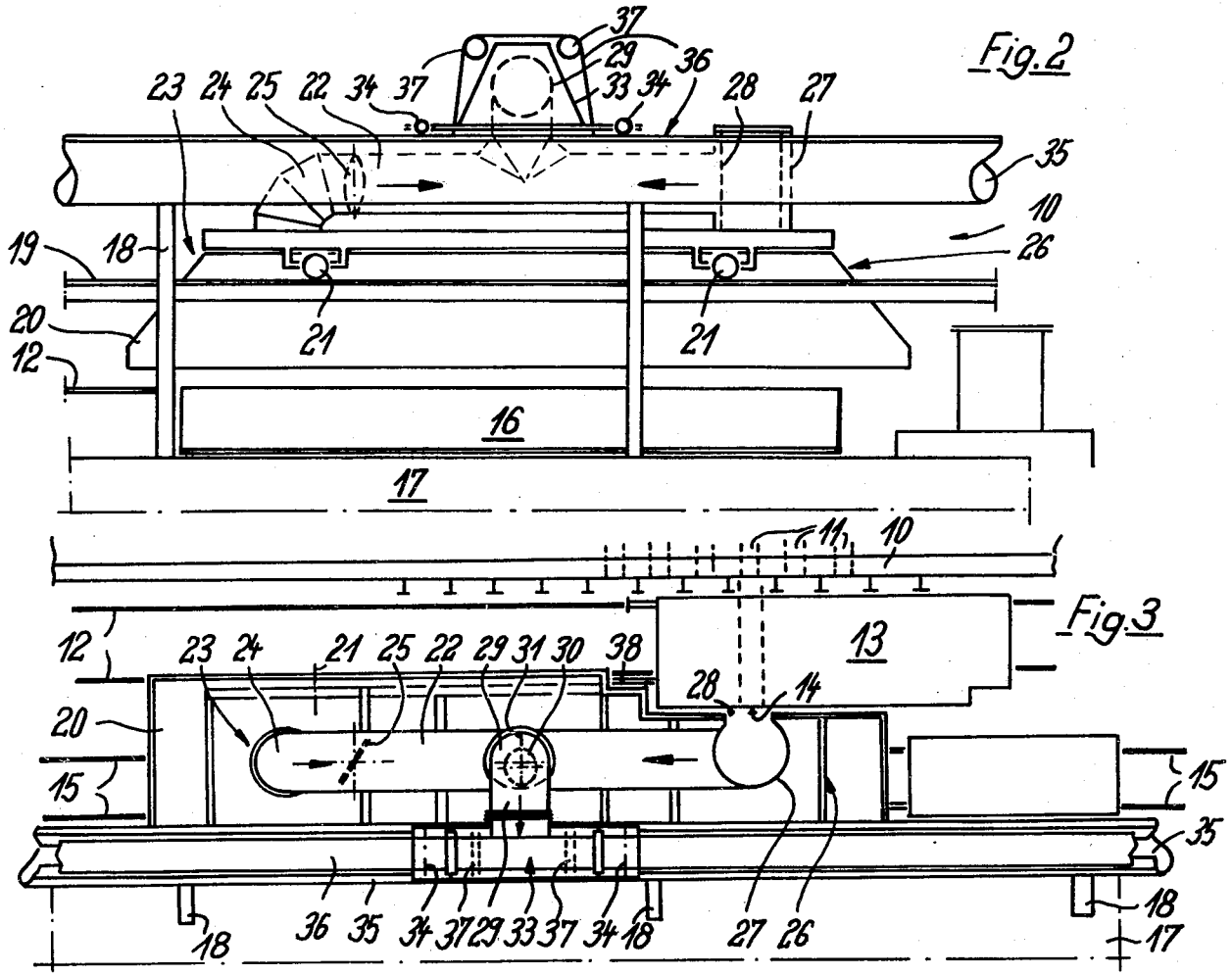
FIG. 2 represents a side view of the hood of FIG. 1.
FIG. 3 is a top view of the hood.

As will be particularly clearly evident from FIGS. 2 and 3, the coke drops from the coke oven chamber 11 through opening 14 and the connecting section 28 into the chute 27. This chute is located at the end 26 of hood 20 at which end the strongest emissions occur. Therefore, within this region the entire cross section of the collector 22 is available for receiving the emissions. At the other end 23 of the hood, less emissions are collected because within said last mentioned region the coke already rests in the quenching car 16. In this last mentioned region, therefore, it is not necessary to keep available the entire suction capacity which can be correspondingly reduced by the throttle valve 25. In this way, within the collector 22, optimum flow conditions can be set.

If a coke oven plant has a plurality of batteries 10 of coke ovens in operation and for servicing the same continuously has two quenching car hoods 20 in operation, it will be appreciated that nevertheless always only one coke oven chamber 11 is pushed. In this connection, it is expedient that the quenching car hood 20 which at that time is not being used can be separated from the collecting main 35 so that the admission of gravity air to the collecting line system will be prevented. To this end, in the withdrawal connection 29 directly adjacent the carriage 33 there is provided the shut-off valve 30. This shut-off valve 30 makes it possible to design the suction blower at the end of collecting line 35 only for a single quenching car hood 20 and for the associated hood 13 of the carriage for transporting the coking mass. The shut-off valve 30 is operable from the central switchboard and is open only as long as the pushing machine is in action. When this process has been completed, also the shut-off valve 30 can be closed again. The shut-off valve 30 need not be opened completely but may be controlled at will in order to maintain a constant pressure differential within the collecting main 35. The adjustment of the shut-off valve 30 may also be selected with regard to the amount of emissions obtained.

The carriage for transporting the coke mass is coupled expediently through a rod 38 to the quenching car hood 20, and the transition between the opening 14 and the connection 28 is designed in a fluid-tight manner.

It is, of course, to be understood that the present invention is, by no means, limited to the specific showing in the drawings, but also comprises any modifications within the scope of the appended claims.

What I claim is:

1. In combination with a displaceable quenching car of a battery of coke ovens disposed side by side in a row with doors in their front ends and having a coke guide car for selective positioning in front of the ovens to receive coke therefrom, and a collecting main for collecting smoke and gases emitted during the door removal and pushing of coke from said battery, said collecting main extending coextensively with said battery and including a continuous flexible belting forming a portion of one side thereof, a device which includes: a first elongated hood for receiving emissions rising from said quenching car, a collector mounted above said first hood and extending in the longitudinal direction of said first hood, duct means arranged at one end portion of said first hood and extending from said first hood to said collector for conveying emissions from said first hood to said collector, an adjustable throttle valve associated with said duct means for controlling the passage of emissions therethrough, a connecting piece connected to the other end portion of said collector, a second hood extending over said coke mass transporting carriage, and provided with an opening adapted to be aligned with said connecting piece, and wighdrawal duct means connected to said collector at an intermediate portion between said duct means and said connecting piece which withdrawal duct means are adapted to communicate with said collecting main and provided with a shut-off flap operable to control the communication between said collector and said collecting main.

2. An arrangement in combination according to claim 1, which includes a chute in which said connecting piece for said second hood is provided therewith, said chute being placed onto the other end portion of said first hood and having its main axis extending vertically.

3. An arrangement in combination according to claim 2, in which said connecting piece has a rectangular cross section corresponding to said second hood.

4. An arrangement in combination according to claim 1, in which said shut-off flap comprises an electrically controllable adjusting member.

5. An arrangement in combination according to claim 1, in which said shut-off flap comprises a pneumatically controllable adjusting member.

6. An arrangement in combination according to claim 1, in which said shut-off flap comprises a hydraulically controllable adjusting member.

7. An arrangement in combination according to claim 1, in which said withdrawal connection is fixedly connected to a band loop carriage displaceable on said collecting main covered by a flat band.

* * * * *